US006558245B2

(12) United States Patent
Abe et al.

(10) Patent No.: US 6,558,245 B2
(45) Date of Patent: May 6, 2003

(54) COIN DISPENSER ASSEMBLY WITH IMPROVED COIN TRANSPORT SURFACES

(75) Inventors: Hiroshi Abe, Iwatsuki (JP); Yoshio Kotake, Iwatsuki (JP)

(73) Assignee: Asahi Seiko Co., LTD, Tokyo (JP)

( * ) Notice: Subject to any disclaimer, the term of this patent is extended or adjusted under 35 U.S.C. 154(b) by 134 days.

(21) Appl. No.: 09/748,999

(22) Filed: Dec. 27, 2000

(65) Prior Publication Data

US 2001/0006883 A1 Jul. 5, 2001

(30) Foreign Application Priority Data

Dec. 29, 1999 (JP) ..... 11-377458

(51) Int. Cl.[7] ..... G07D 1/00
(52) U.S. Cl. ..... 453/57; 198/540
(58) Field of Search ..... 453/57, 63; 193/DIG. 1; 194/350; 198/550.01, 550.2, 540; 52/192, 197

(56) References Cited

U.S. PATENT DOCUMENTS

| | | | | | |
|---|---|---|---|---|---|
| 4,396,029 | A | * | 8/1983 | Anderson | 453/15 |
| 4,574,824 | A | * | 3/1986 | Paulsen et al. | 366/325.92 |
| 4,752,274 | A | | 6/1988 | Abe | 453/32 |
| 5,061,222 | A | | 10/1991 | Suris | 453/57 |
| 5,064,404 | A | * | 11/1991 | Champion | 221/203 |
| 5,066,262 | A | | 11/1991 | Abe | 453/57 |
| 5,074,824 | A | | 12/1991 | Suris | 453/57 |
| 5,122,094 | A | | 6/1992 | Abe | 453/57 |
| 5,474,495 | A | * | 12/1995 | Geib et al. | 453/10 |
| 5,988,348 | A | * | 11/1999 | Martin et al. | 194/317 |
| 6,039,166 | A | | 3/2000 | Abe et al. | 194/317 |

FOREIGN PATENT DOCUMENTS

| | | | | | |
|---|---|---|---|---|---|
| GB | 2 142 613 | A | * | 1/1985 | G07D/1/00 |

OTHER PUBLICATIONS

Asahi General Catalog 1997.

* cited by examiner

*Primary Examiner*—Donald P. Walsh
*Assistant Examiner*—Mark J. Beauchaine

(57) ABSTRACT

A coin dispensing assembly with an improved coin transport surface facilitates a sliding movement of coins within a hopper through the use of a low friction wall surface for contacting the coins as they move towards a coin feed mechanism. The wall surface can have protrusions of a substantially smaller size than the coin which are arrayed to provide minimal contact with the coin surface. Alternatively, a plastic liner can be fastened to the wall of the hopper assembly and can include graphite particles on its surface for contacting the coins. The graphite particles will have a substantially higher hardness than that of the coin, thereby preventing scratching and the formation of metal particles within the hopper.

22 Claims, 7 Drawing Sheets

COIN DISPENSER ASSEMBLY WITH IMPROVED COIN TRANSPORT SURFACES

BACKGROUND OF THE INVENTION

1. Field of the Invention

The present invention discloses a high capacity, high speed coin dispensing assembly capable of ejecting coins or tokens of a disk like form from a hopper containing bulk loose coins and in particular a low coefficient of friction surface for sloping walls of the hopper to promote the transport of the coins.

2. Description of the Related Art

Various types of coin ejecting devices have been used in vending machines, gaming machines, arcade games, etc. Generally, at least one storage or hopper tank is provided with an opening at the top for receiving bulk coins and an exit opening for introducing the coins into a coin segregating and dispensing member so that individual coins can be removed from the hopper and dispensed at a high speed. Coins used in this field include not only monetary coins, but medals, tokens, medallions and other usually circular disk components that represent a unit of value to the user. For example, tokens can be dispensed on arcade games to be redeemed for additional rides and prizes, while actual monetary coins are frequently dispensed in slot machines in a gaming environment.

An example of one form of a coin dispensing device can be seen in Japanese laid open patent publication no. 8-110960. Referring specifically to FIGS. 9–11, a coin dispensing device 10 contains a cylindrical hopper tank 11 with an open mouth for receiving either an individual or bulk supply of coins. Mounted adjacent the bottom of a cylindrical hopper tank 11 is a coin delivery mechanism 12 that can be driven by a electric motor 16 through a speed reduction gear assembly 17 so that an output shaft 18 will rotate a coin feed disk member 14. The driving motor 16 and the speed reduction gear assembly 17 are fixed to an inclined base 15 as shown in FIG. 11. A guard plate 19 extends partly over the lower portion of the hopper tank 11 in order to partially cover the coin feed disk 14 to prevent a clogging of coins. The guard plate 19 also constitutes a sloping portion 19A and can be fixed within the hopper tank 11 by a hinge 20. The guard plate 19 can be rotated from an upper to a lower position in FIG. 10 to permit surface access to the coin feed disk 14. The guard plate 19 can be molded of a resin material and as seen in FIG. 11 provides a exit opening 21 to permit the passage of coin C to be able to reach the coin feed disk 14.

The coin feed disk 14 will have a plurality of coin receiving holes that are dimensioned to receive the coins to be dispensed. The coin receiving holes are usually formed in a outer peripheral portion of the disk 14 at fixed intervals. A coin C that passes through the opening 21 will enter a coin receiving hole and then subsequently with the rotation of the coin feed disk 14 can be discharged through a slot to the outside of mechanism. The guard plate 19 prevents a jamming of an excess of coins which could occur if the entire bulk of coins bear against the surface of the coin feed disk 14. As shown in FIGS. 9 and 10, the hopper tank 11 has an upper rectangular portion 11U and a lower cylindrical portion 11L with an intermediate slopping portion 11M. The hopper tank 11 basically proceeds from a larger upper opening area to progressively become smaller to accommodate the transportation of coins to the coin feed disk 14. As shown in FIG. 10, a bracket division or portion 19F can contact the slope 11R of the intermediate 11M portion of the hopper. These dimensions are designed to prevent obstructions of the stored coins as they progress within the hopper. The bracket portion 19F provides a fixed distance between the tip 19T of the guard plate 19 and the slope 11F of the intermediate portion 11M of the hopper. The hopper tank 11 can be formed of a plastic resin.

As shown in FIG. 11, a coin transport carrier 22 which can constitute a belt can deliver coins that have been deposited within the machine for storage within the hopper tank 11. The coin C is delivered by a gravity feed and the slopes of the intermediate portion of the hopper 11M are designed to facilitate movements of the coin C to the coin delivery disk 14. Coins that have been stored in bulk on sloped portions for example, of 11E and 11F permit a gravity feed of the coins to the exit opening 21. Referring for example to FIG. 10, an opening 23 can be provided on a slope 11F of the hopper tank 11 to permit coin observation or detection. Additionally, electrodes 24A and 24B can also project within the hopper tank to determine the level of fill of bulk coins within the hopper. The design of the hopper surface is an attempt to align the coin as it extends through the opening 21 with coin receiving holes in the coin feed disk 14. The exit opening 21 assists in this alignment procedure, but as shown in FIG. 11, can create a problem in that coins can be jammed in the exit opening 21 to create a blockage which is sometimes referred to as a bridge phenomena in this industry. When the bridge phenomena arises, the coins can not reach the coin feed disk 14 and consequently, coins cannot be dispensed. This renders the machine inoperative and requires service.

It has been found that when the hopper tank 11 is made of resin, that a clogging problem arising from the bridge phenomena can occur approximately once out of every 20,000 coins being delivered. As the dispensing speed of coins is increased in this industry, this creates a problem that can be expensive because of the maintenance labor cost and down time of the machine.

There have been various attempts to prevent clogging within hoppers such as providing agitators that will rotate at the bottom of a hopper tank and thereby agitate the coins C. Such an agitation can address the problem of bridge phenomena. The cost of adding an additional agitator member increases the overall cost of the coin dispensing apparatus, removes some storage space, and adds an additional moving part that can be subject to mechanical failure.

Thus, there is still a demand in the prior art to try and improve the dispensing of coins in bulk from a hopper in an economical and efficient manner.

SUMMARY OF THE INVENTION

The present inventions provides a coin dispensing hopper assembly that can store and dispense coins in bulk by a gravity feed of the coins to a coin feed mechanism that can segregate and dispense individual coins. The hopper assembly includes hopper walls having a sloping downward configuration to enable a gravity feed of the coins. At least one wall surface will be provided with a low friction structure for contacting the coins as they move toward the coin feed mechanism.

In one embodiment of the invention, a plastic liner member can be fastened to the wall of the hopper assembly by adhesive or two-way tape to provide the low friction wall surface. The plastic liner member can include graphite particles on its surface for contacting the coins with the graphite particles capable of having a Rockwell Hardness substantially higher than that of any metal powder scraped from the coins. A plastic liner member can include a synthetic polyamide material that can be extruded with the graphite particles so that the coefficient of friction of the plastic liner member can be in the range of 0.16 to 0.30. The low friction wall surface can include a plurality of raised protrusions of graphite particles. An alternative embodiment can have a low friction wall surface formed of a stainless steel with dimpled protrusions of a configuration substantially smaller than the coin to thereby provide a transport of the coin body over the substrate surface of the wall.

Thus, the present invention can provide an improved coin dispensing hopper assembly for storing and dispensing coins having walls that slope downward to enable a gravity feed of coins to a coin feed mechanism. The coin feed mechanism can segregate and dispense individual coins. The coins are delivered to the coin feed mechanism by transport across a low friction wall surface. The low friction wall surface can be formed by integral protrusions that can be formed with the formation of the wall surface, or alternatively, by a plastic liner that can include protrusions such as embedded graphite particles of a small scale. As a result of these embodiments, the generation of a bridge phenomena of coins in a hopper tank can be decreased without decreasing the storage capacity of the hopper tank.

BRIEF DESCRIPTION OF THE DRAWINGS

The exact nature of this invention will be readily apparent from consideration of the following detailed description in conjunction with the accompanying drawings, wherein.

DETAILED DESCRIPTION OF THE PREFERRED EMBODIMENTS

Figure 1:
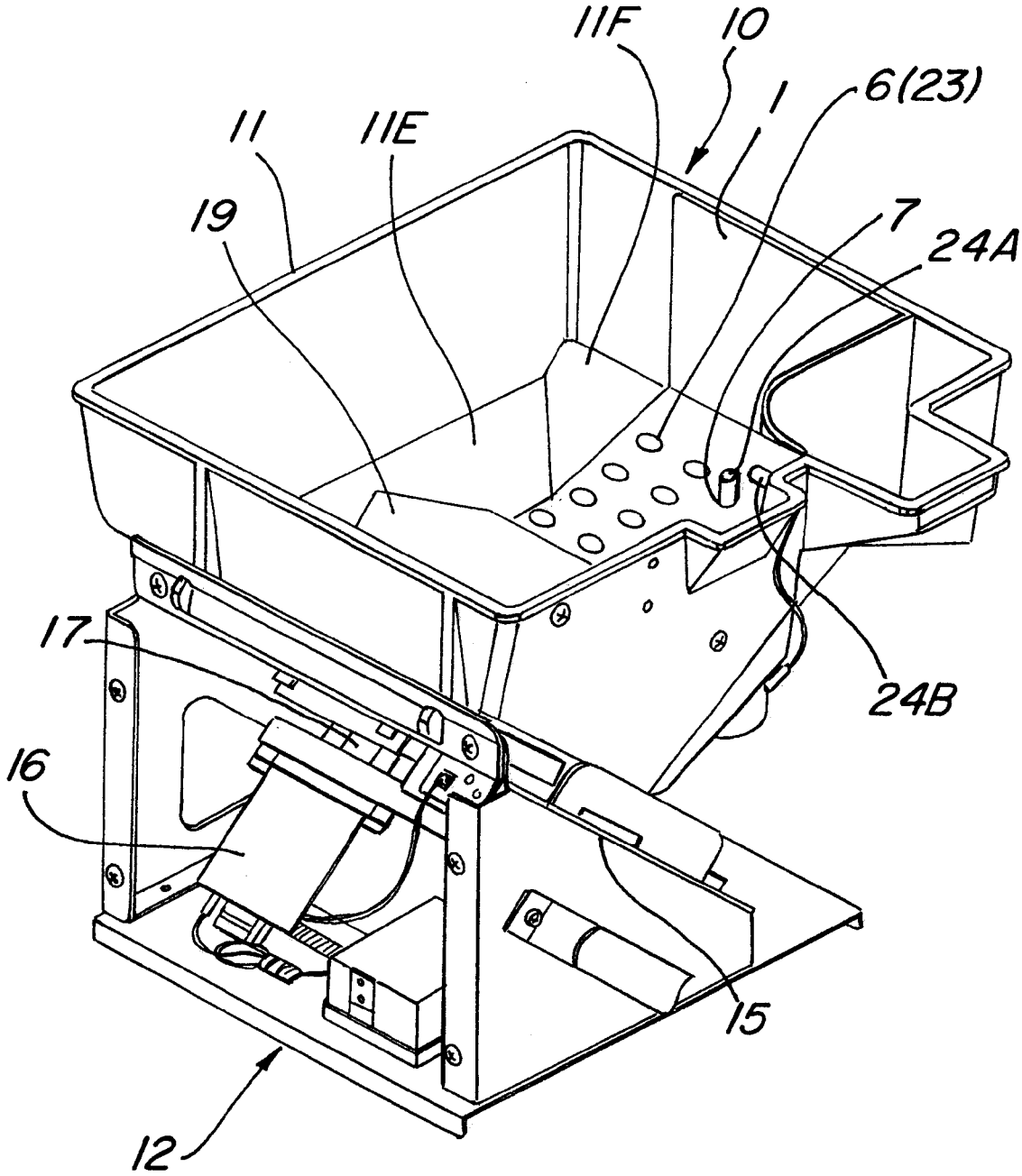
FIG. 1 is a perspective view of a first embodiment of the present invention.

The following description is provided to enable any person skilled in the art to make and use the invention and sets forth the best modes contemplated by the inventors of carrying out their invention. Various modifications, however, will remain readily apparent to those skilled in the art, since the general principles of the present invention have been defined herein to specifically provide a coin dispenser assembly with an improved hopper coin transport surface.

The embodiments of the present invention address the problem of a bridge phenomena in a coin dispensing hopper assembly with an economical construction and configuration that does not require coin agitators.

It is believed that the generation of the bridge phenomena can occur as a result of the delivery of the coins C rubbing against each other and also against the internal surfaces of the coin dispenser apparatus. As a result of this friction, not only debris from the surface of the coin, but actual minute metal powder can be generated that can adhere to the hopper tank internal surface. When the hopper tank 11 is made of resin, such as acrylonitride butadiene styrene, this metal powder can create a static electricity problem as the metal coins rub against the accumulated metal powder. The metal powder, when contacted by the weight of the coin as it slides on a slope 11F, can roll or slide with the coin and can create scratches in the resin surface with the metal powder abrading and biting into the resin. When metal powder accumulates in such scratches, it is not removed by contact with a sliding coin. Additionally, the dropping of coins into the hopper tank inner surface can cause indentations in a plastic resin hopper and also roughen up the slope of the respective sloping walls 11R, 11E, and 11F, and thereby increase the accumulation of the metal powder. This in turn can increase the coefficient of friction for these slopes. As a result, the sliding of the coins on such slopes deteriorate and the coins can then build up to create the bridge phenomena.

Alternatively, it may be considered to form the hopper tank from a metal material or at least provide the appropriate sloping surfaces 11F, that can constitute the exited opening 21, to be covered in a stainless steel cover plate. However, this still does not avoid the problem of accumulating metal powder and scratches over a period of time and again the bridge phenomena of the coins can be experienced. Another alternative approach would be to increase the tilt angle of the slope 11F so that the coins could then slide easier on such a slope. This approach, however, is difficult to be adopted since the capacity of a small hopper tank 11 will decrease as the inclination angle is increased.

In the subsequent drawings, common part numbers will be identified throughout the drawings. Referring to the first embodiment of FIG. 1, a hopper 10 can be provided with a low friction wall surface for contacting the coins as they move towards the coin delivery mechanism 12 by the addition of a low friction sheet 1 that can be affixed to a major portion of the slope 11F that extends to the exit opening 21 and thereby forms a low friction coefficient plane. The low friction sheet 1 can be affixed at the upper 11U portion as an extension of the slope 11F. The low friction sheet 1 can be further affixed to the downward part of the slope 11E. The sheet 1 can be formed of a synthetic polyamide material such as Nylon™ which is a trademark of the DuPont Company. The sheet 1 can be bonded to the hopper surface by means of an adhesive, or alternatively, by means of a tape with a double sided adhesive. Alternatively, an adhesive that can both penetrate the sheet 1 and hopper tank wall can be utilized.

As shown in FIG. 1, sheet 1 can also be provided with a hole or aperture 6 that is perforated into the sheet and aligned relative to a hole 23 in the hopper for coin observation. Additionally, holes 7 can be provided to permit an extension of the electrode 24A into the interior of the hopper for coin detection purposes.

The production of sheet 1 can be accomplished by providing raw material in the form of a synthetic polyamide resin material which is mixed with a graphite particle of a scale state and then extruded from a mouth piece of an extrusion vessel to form a sheet like configuration that is ejected into a water bath for cooling and solidification. The material can moderately absorb some of the water and then it is subsequently compressed and extended by a heat roller. As a result of this procedure, a small scale state graphite particle is deposited in the sheet surface to provide minor protrusions and to create a coefficient of friction that is as small as 0.16 to 0.30. The graphite can have a Rockwell Hardness which is significantly higher than the Rockwell Hardness of any potential metal powder from the coins. As a result, the plastic liner member will be excellent in abrasion resistance.

Alternatively, the present invention can be manufactured from a material sold under the tradename Polislider that is provided by the Asai Polislider Company Ltd. of Japan.

By the use of the plastic liner sheet 1, a coin C will smoothly slide across the sheet on the slope 11F due to the low coefficient of friction and will thereby substantially decrease the occurrence of the bridge phenomena. A coin C that is located near the wall surface sheet 1 on the slope 11F will slide faster than a coin which is located near another wall surface as it is sliding downward. Thus, the coin C can easily pass through the exit opening 21 to reach the coin feed disk 14. Additionally, the problem of the accumulation of metal powder from the coins is substantially reduced since the metal powder does not easily extend between the graphite particles to adhere to the sheet 1. The scale state graphite particles are arranged at a density which can be smaller than the size of the metal powder. This prevents the metal powder from creating an irregular surface. Additionally, the graphite Rockwell Hardness is substantially higher than the Rockwell Hardness of the metal powder so that scratching abrasions are not easily created on the graphite. Thus, any metal powder that would adhere on sheet 1 is generally adhered only as a result of a static electricity problem and the movement of the coin C provides a self-cleaning effect by scratching or abrading the metal powder away as it slides down the slope 11F. As a result of such self-cleaning, a minimal quantity of metal powder will accumulate and according to experiments, the generation of bridge phenomena can be reduced to only an average of once in 200,000 dispensing of coins. Therefore, an improvement of ten times, with resulting reduction in costs, while obtaining an economic construction format for the coin dispensing apparatus is achieved over that of the conventional coin dispensing devices. Thus, as seen in FIGS. 1–3, the provision of the plastic liner member 1 on respectively the upper interior wall 11U and the sloping wall 1 IF help prevents the bridge phenomena from occurring in the opening 21.

Figure 2:
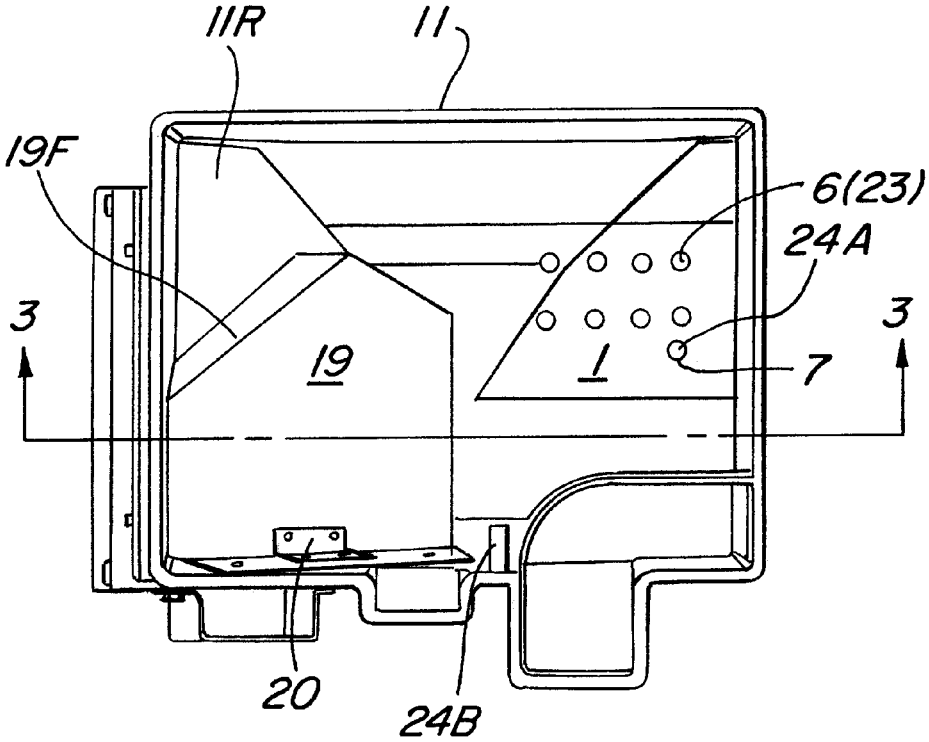
FIG. 2 is a top plan view of the first embodiment of the present invention.
Figure 3:
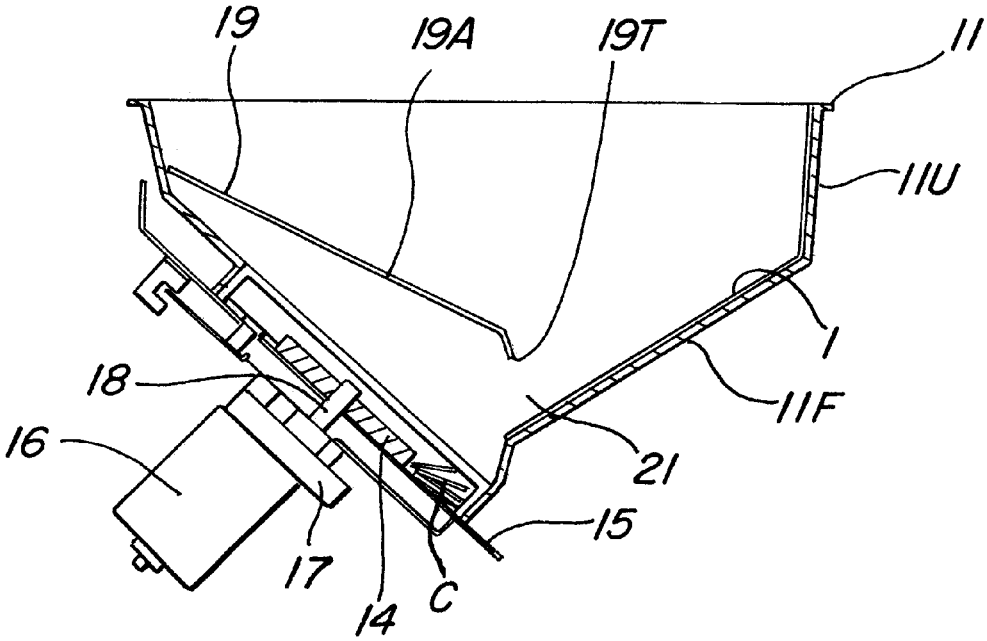
FIG. 3 is a cross sectional view along lines 3—3 of FIG. 2.
Figure 4:
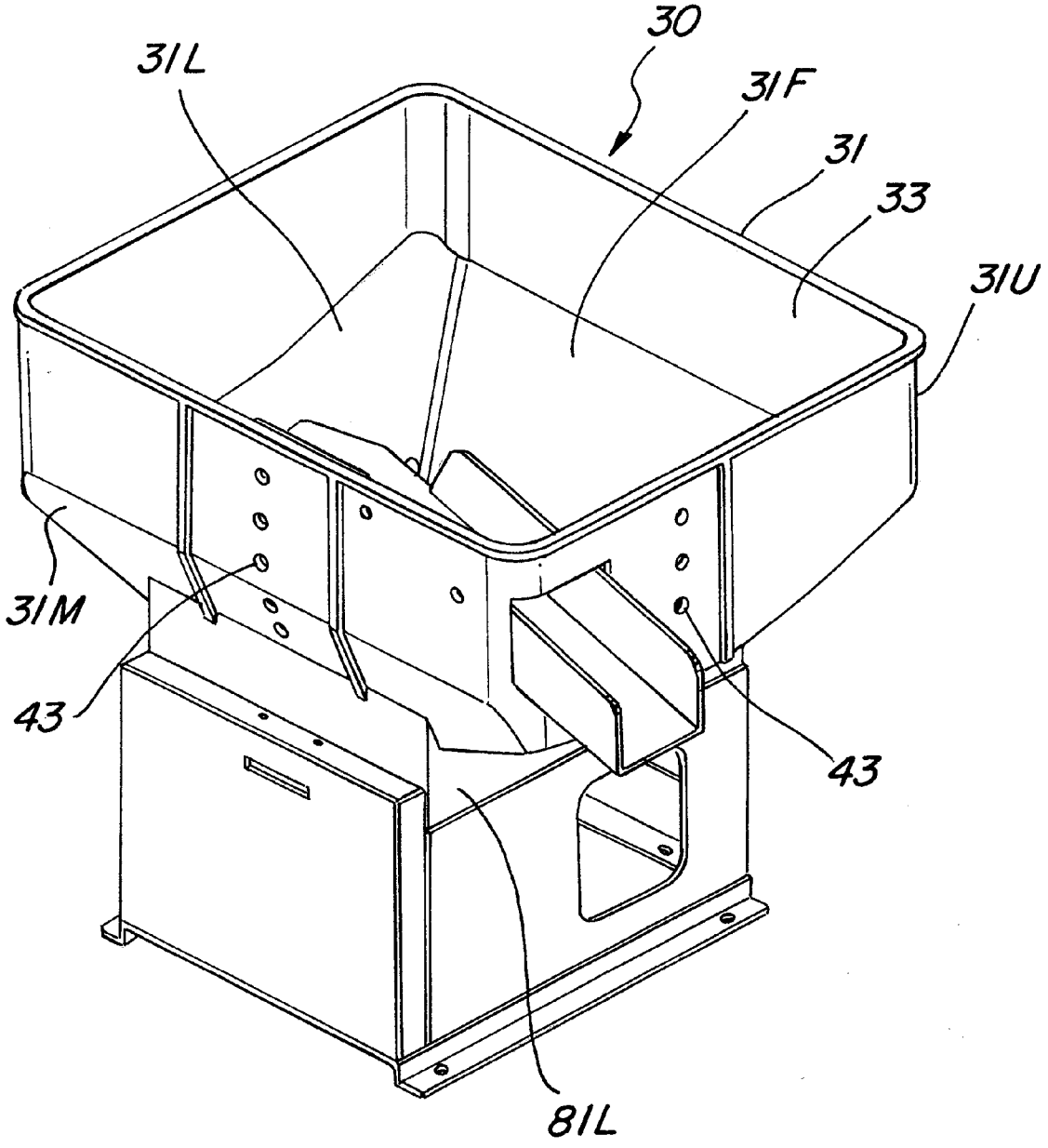
FIG. 4 is a perspective view of a second embodiment of the present invention.
Figure 5:
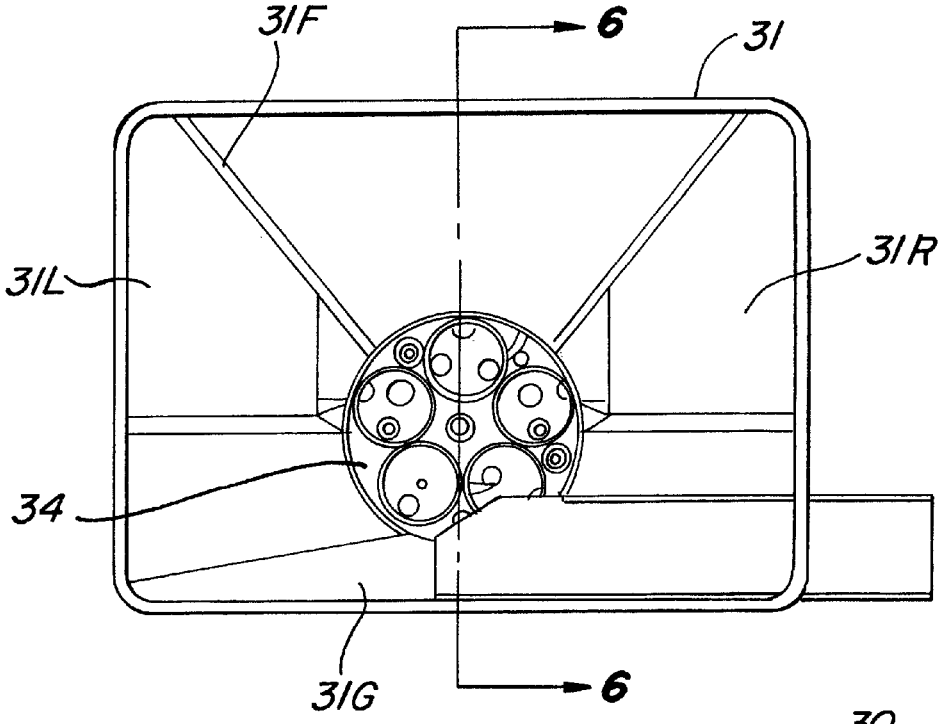
FIG. 5 is a top plan view of the second embodiment of the present invention.
Figure 6:
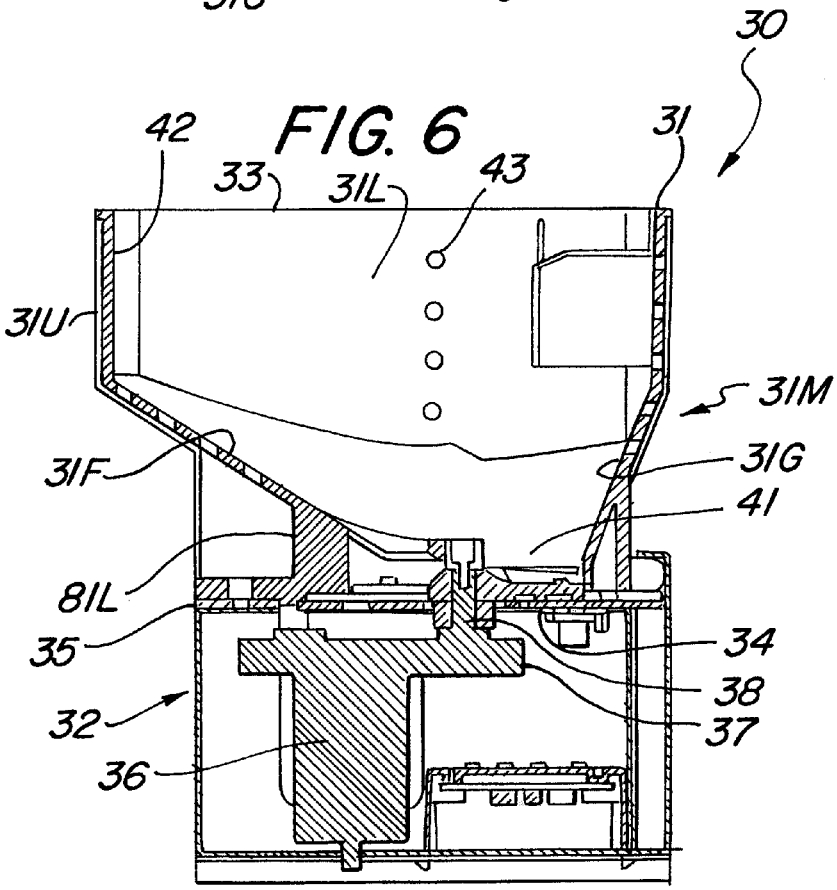
FIG. 6 is a cross sectional view taken along the lines 6—6 of FIG. 5.

Referring to the second embodiment of the present invention disclosed in FIGS. 5 and 6, a coin feed disk 34 is positioned in a horizontal plane as opposed to the inclined plane of the embodiment of FIGS. 1–3. The coin dispensing hopper assembly 30 includes a cylindrical hopper tank 31 and a coin delivery mechanism 32 that is coupled to the bottom of the hopper tank. The hopper tank 31 has an upper wall surface 31U and a lower wall surface 31L with an intermediate sloping surface 31M. The upper surfaces are substantially rectangular in configuration, while the lower surface 31L is substantially cylindrical and much smaller than the upper surface 31U. The intermediate portion 31M is connected between the upper surface 31U and the lower surface 31L with a downward sloping configuration. The intermediate portion 31M includes the slopes 31F, 31G, 31L and 31R. The hopper tank 31 can be formed of a plastic resin material. 33 is the opening to the upper part of 31U.

As can be seen, the coin feed disk 34 is mounted on a horizontal plane at the bottom of a lower sloping surface 31L to form part of the delivery mechanism 32. Again, drive motor 36 can be connected to a speed reduction gear system 37 in order to drive the coin feed disk 34 through an output shaft 38 that extends through the horizontal substrate 35. The lower surface 81L of the hopper tank 31 is affixed to the horizontal substrate 35. The exit opening 41 of the hopper tank 31 is positioned adjacent the lower surface 31L. The low friction sheet 42 can be affixed to the position of the slope 31F and the upper 31U following it. Additionally, the sheet or additional sheets can be affixed at the slopes 31F, 31G and 31R. Since the slopes 31F, 31G and 31R have a large angle, it is therefore possible to smoothly slip the weight of the coin C even if there is some roughness that increases in these planes. Coin C will be naturally dropped downward by the weight of the coin and any overlying coins. Coin C will be guided at slopes 31F, 31R, 31L and 31G at the intermediate portion 31M so that they will slip to the exit opening 41. As it passes through the exit opening 41, the coin C will reach the coin feed disk 34 and thereby be segregated and subsequently by rotation of the coin feed disk 34 discharged outside of the coin dispenser hopper assembly. Again, a series of holes 43 can be used for coin observation.

Figure 7:
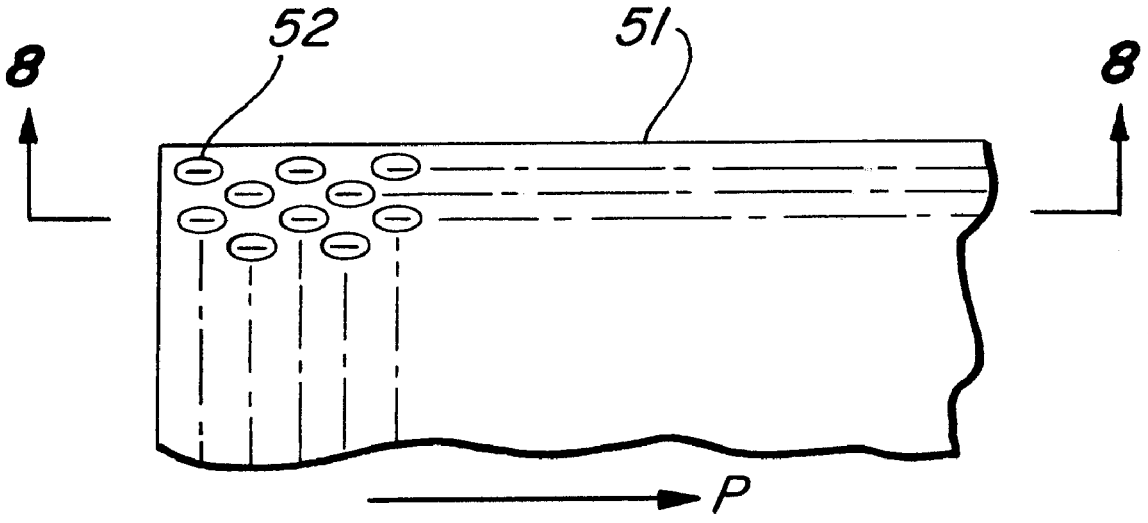
FIG. 7 is a partial top view of a third embodiment of the present invention.
Figure 8:
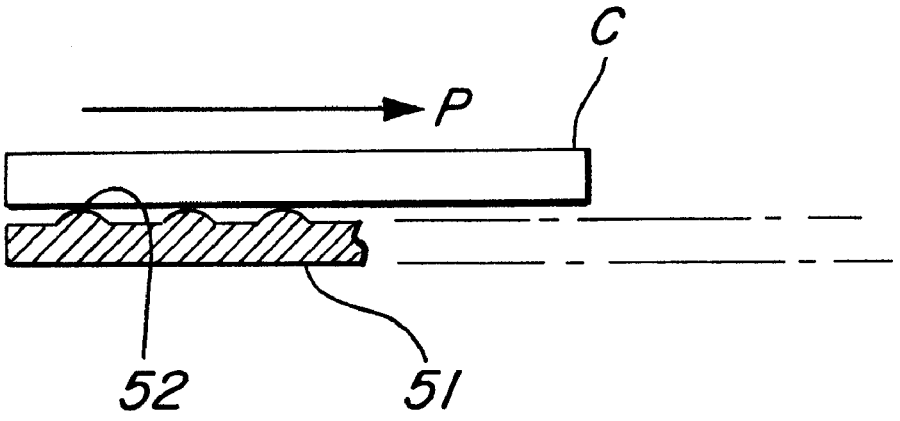
FIG. 8 is a cross-sectional view with a coin C on top taken along the line 8—8 of FIG. 7.
Figure 9:
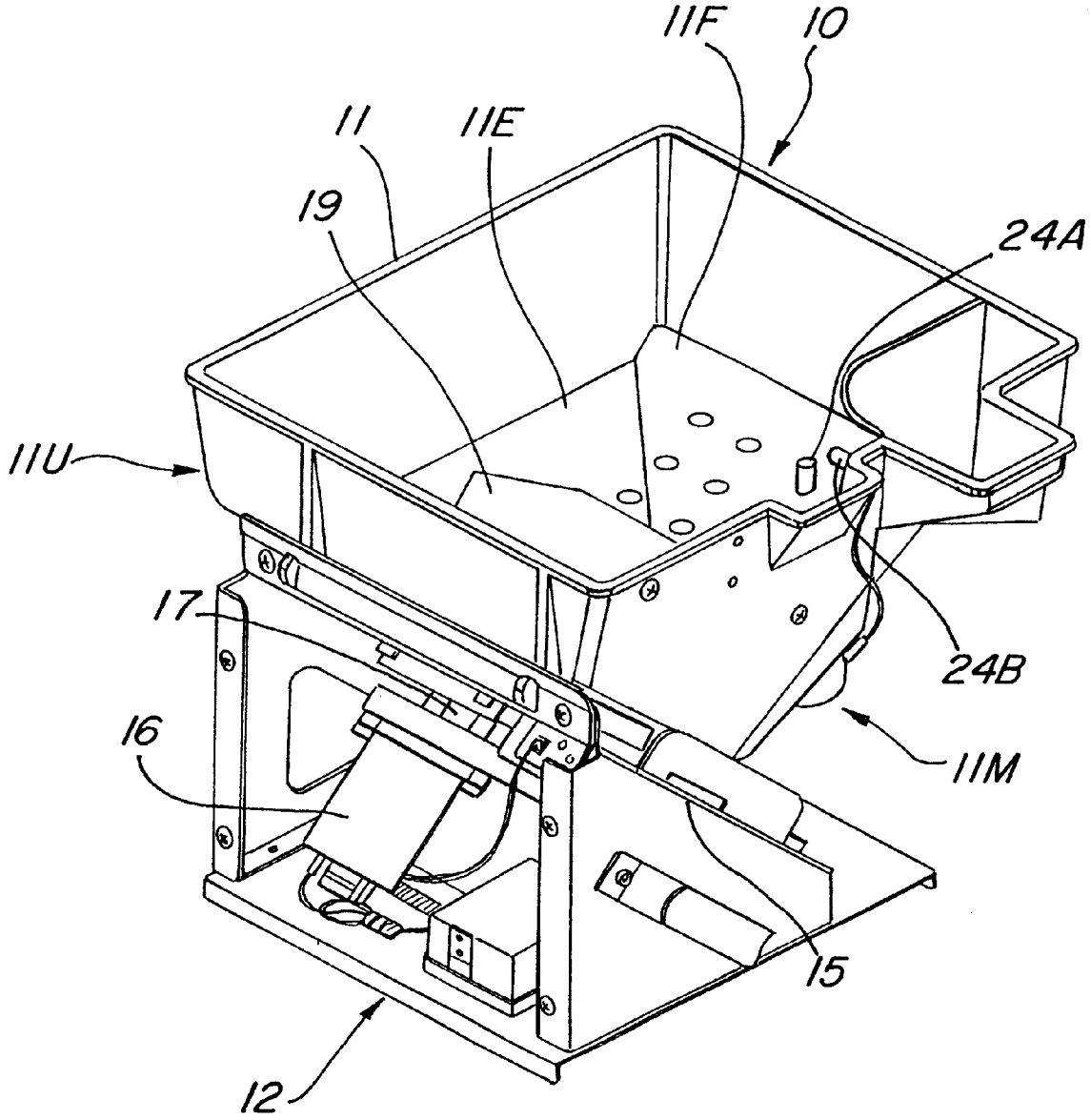
FIG. 9 PRIOR ART
FIG. 9 is a perspective view of a prior art coin dispensing device.
Figure 10:
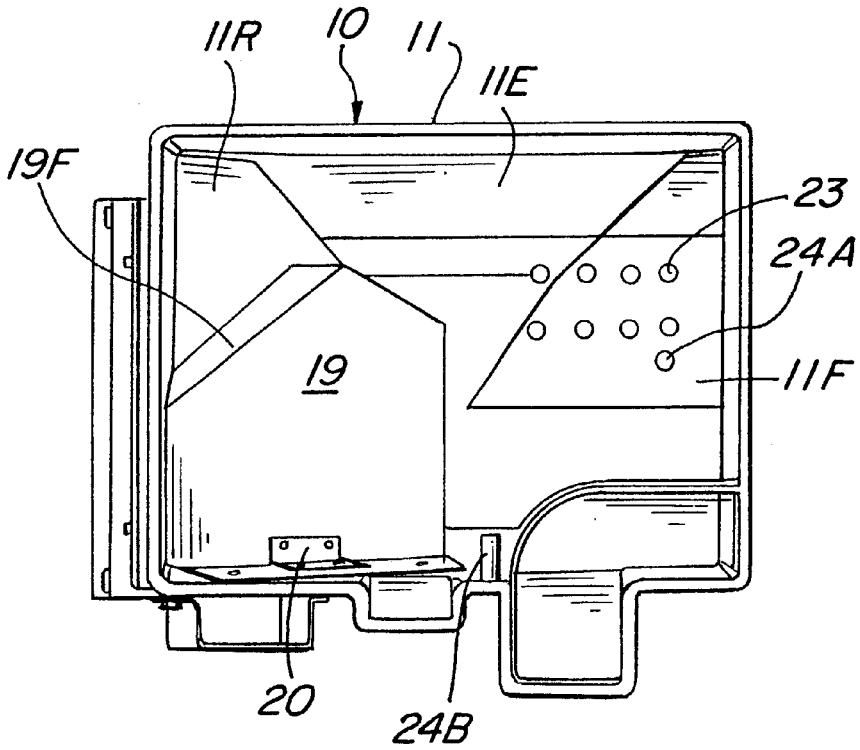
FIG. 10 PRIOR ART
FIG. 10 is a top view of FIG. 9.
Figure 11:
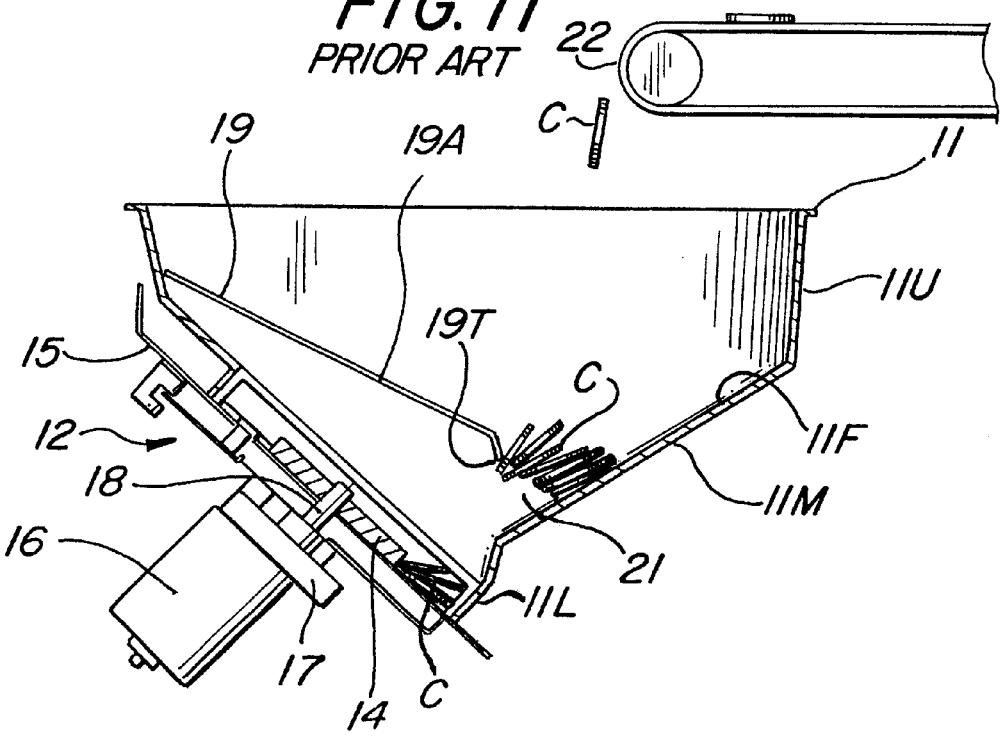
FIG. 11 PRIOR ART
FIG. 11 is a partial cross-sectional view of a prior art device.

A third embodiment of the invention is disclosed in FIGS. 7 and 8 which represent a partial surface structure of the interior of a hopper. As shown in FIG. 7, a sheet 51 which can be formed of either a metal such as stainless steel or a plastic resin is formed with minute protrusions 52 such as ovals having a width of 4 mm, a length of 10 mm, and a height of 0.3 mm that extend upward from the substrate surface. Protrusions of an oval configuration can be aligned in an array as seen in FIGS. 7 and 8. As shown along the length of the oval, a coin C can move in the direction P so that the surface of the sheet 51 is not contacted by the coin. The oval protrusions are substantially smaller than the diameter of the coin and provide a plurality of point contacts for contacting the coin surface. The frictional force generated between the sheet 51 and the coin C can be influenced according to the area at the top of protrusions 52 and the number of contacting protrusions 52. Thus, the area in which one protrusion 52 will contact the coin C can be extremely small. Any metal powder which has been cut by the protrusion 52 will be relatively small in quantity since the area of the protrusion 52 are relatively small and the frictional resistance for the coin C will not increase. Additionally, any metal powder that accumulates on the slope between the protrusion 52 will take a long time until the sedimentation metal powder reaches the level of the protrusion 52. Since the metal powder which may accumulate and piles up between the protrusions will not have an affect, it also can be easily removed by a wiping motion by the normal maintenance service on the hopper assembly. As can be readily appreciated, since the provision of these protrusions remove the impact of the accumulation of metal powder while providing a small contact area with the coin C, it is highly advantageous to economically incorporate such a configuration, either directly into the hopper wall as an integral portion of the formation of the hopper wall, or through the addition of an interior liner sheet on the hopper wall surface.

As a result of the embodiments of the present invention, a coin dispenser assembly with an improved coin transport surface on the hopper can be economically formed to provide a low coefficient of friction sliding surface. Coins that approach any exit opening are easy to slide within the hopper even if metal powder does adhere to the substrate surface between protrusions. The embodiments of the present invention help reduce a bridge phenomena and the embodiments can be relatively economically produced without the additional cost of driven agitator units. The coins within the hopper are easy to slide across the slope even if the angle of the slope is not drastically increased. Thus, the coin storing capacity of the hopper tank is maintained.

In using a plastic liner having graphite particles, there is a decreased scratching and cutting into the plastic liner while maintaining a low coefficient of friction sloping plane. The sheet can be self-cleaning since the sliding of the coin will remove any metal powder debris without cutting the graphite particles. The plastic liner can be easily adhered and bonded to the inner surface of the hopper tank. Thus, in the highly competitive environment of coin dispensing apparatuses, the present invention, as set forth in the various embodiments, can address and resolve coin bridging problems in an economical manner. As can be appreciated, other forms of plastic and particles can be utilized consistent with providing a hard, low coefficient of friction surface.

Those skilled in the art will appreciate that various adaptions and modifications of the just-described preferred embodiments can be configured without departing from the scope and spirit of the invention. Therefore, it is to be understood that, within the scope of the appended claims, the invention may be practiced other than as specifically described herein.

What is claimed is:

1. In a coin dispensing hopper assembly for storing and dispensing coins having walls that slope downward to enable a gravity feed of coins to a coin feed mechanism that segregates and dispenses individual coins, the improvement comprising:

a low friction sheet which is affixed on a sloping wall for contacting the coins as they move towards the coin feed mechanism.

2. The invention of claim 1 wherein the low friction sheet is a plastic liner member that is fastened to a wall of the hopper assembly.

3. The invention of claim 2 wherein the plastic liner member includes graphite particles on its surface for contacting the coins.

4. The invention of claim 3 wherein the plastic liner member includes an array of protrusions no larger than 0.3 mm in height.

5. The invention of claim 3 wherein the plastic liner member includes a synthetic polyamide material.

6. The invention of claim 2 wherein the plastic liner member is adhered to a wall of the hopper assembly by an adhesive tape.

7. The invention of claim 1 wherein the coefficient of friction is in the range of 0.16 to 0.30.

8. The invention of claim 1 wherein the low friction sheet includes a plurality of raised protrusions from a substrate.

9. The invention of claim 8 wherein the low friction sheet is formed of a plastic resin.

10. The invention of claim 8 wherein the low friction sheet is formed of stainless steel.

11. A coin dispensing assembly comprising:

a coin storage hopper member with downwardly sloping walls for storing coins in bulk;

a coin segregating and dispensing member operatively positioned below the sloping walls of the hopper member for receiving the coins, segregating individual coins and dispensing the individual coins; and a plastic liner member attached to and covering a downwardly sloping wall adjacent the coin segregating and dispensing member to provide a lower frictional wall surface than the hopper member sloping wall surface whereby the coins are transported in a sliding manner to the coin segregating and dispensing member.

12. The invention of claim 11 wherein the plastic liner member includes graphite particles on the surface for contacting the coins.

13. The invention of claim 12 wherein the Rockwell Hardness of the graphite particles is higher than the contacting coins.

14. The invention of claim 11 wherein the plastic liner member includes a synthetic polyamide material.

15. The invention of claim 11 wherein the coefficient of friction is in the range of 0.16 to 0.30.

16. The invention of claim 11 wherein the plastic liner member is adhered to a wall of the hopper assembly by an adhesive tape.

17. A coin dispensing assembly comprising:

a coin storage hopper member with downwardly sloping walls for storing coins in bulk; and a coin segregating and dispensing member operatively positioned below the sloping walls of the hopper member for receiving the coins, segregating individual coins and dispensing the individual coins, a low friction sheet which is affixed on at least one sloping wall, the sheet includes a plurality of protrusions extending from the sheet that are smaller in size than the coin to be distributed to providing a sliding transportation of the coins across surfaces of the protrusions to the coin segregating and dispensing member.

18. The invention of claim 17 wherein the protrusions are integral with the low friction sheet.

19. The invention of claim 17 wherein the protrusions are graphite.

20. The invention of claim 19 wherein the low friction sheet is formed of a plastic resin.

21. The invention of claim 17 wherein the low friction sheet is stainless steel.

22. The invention oc claim 17 further including a plastic liner member with protrusions adhered to the wall surface.

* * * * *